US005549156A

United States Patent [19]

Borden

[11] Patent Number: 5,549,156

[45] Date of Patent: Aug. 27, 1996

[54] SHOCK ABSORBER & WIPER

[76] Inventor: B. Michael Borden, Sapulpa, Okla.

[21] Appl. No.: 465,833

[22] Filed: Jun. 6, 1995

[51] Int. Cl.[6] ..... E21B 34/02

[52] U.S. Cl. ..... 166/84.2; 74/41

[58] Field of Search ..... 166/75.11, 82.1, 166/83.1, 84.1, 84.2; 74/41, 108

[56] References Cited

U.S. PATENT DOCUMENTS

| | | | |
|---|---|---|---|
| 3,032,112 | 5/1962 | Webster | 166/84 |
| 3,186,722 | 6/1965 | Johnston | 277/32 |
| 3,270,810 | 9/1966 | Johnston | 166/84 |
| 3,353,606 | 11/1967 | Dyer | 166/84 |
| 3,939,910 | 2/1976 | Bruce | 166/84 |
| 4,176,714 | 12/1979 | Case | 166/72 |
| 4,345,766 | 8/1982 | Turanyi | 277/30 |
| 4,354,395 | 10/1982 | Page | 74/41 |
| 4,354,397 | 10/1982 | Fix | 74/41 X |
| 4,445,674 | 5/1984 | Clayton | 74/41 X |
| 4,498,845 | 2/1985 | Pittman et al. | 74/41 X |
| 4,896,367 | 1/1990 | Newton et al. | 166/84.1 X |
| 4,981,174 | 1/1991 | White | 166/84.2 |
| 4,982,787 | 1/1991 | Reddoch | 166/82 |
| 5,058,668 | 10/1991 | Newton | 166/84.1 |
| 5,137,083 | 8/1992 | Bump | 166/84.2 |
| 5,170,853 | 12/1992 | Mason et al. | 175/84 |
| 5,211,227 | 5/1993 | Anderson | 166/84 |
| 5,217,068 | 6/1993 | Newton | 166/84.2 |
| 5,217,069 | 6/1993 | Badon | 166/84 |
| 5,289,884 | 3/1994 | Johnstone | 166/387 |

*Primary Examiner*—Roger J. Schoeppel
*Attorney, Agent, or Firm*—Head, Johnson & Kachigian

[57] ABSTRACT

A safety shock absorber and wiper for use in an oil well pumping unit and attached to the top of a stuffing box. The shock absorber and wiper is constructed of a high density elastomeric material which is designed to absorb the shock created in the event a polished rod breaks or slips out of the polished rod clamp and the polished rod liner head falls and impacts the top of the stuffing box. A series of circular lip seals are formed on the inside of a passage which receives the polished rod liner. The lip seals make contact with and wipe the polished rod liner. A rigid ring is encased near the bottom of the device to provide a rigid portion so that the device can be secured to the stuffing box in such a manner as to compress a seal and prevent leaks around the mating surface. The device additionally contains a lubricant cavity so that a polished rod liner receives lubricant during start-up and all times during the pumping operation to reduce the wear, friction, and corrosion of and to the stuffing box packing and the polished rod liner. By wiping the polished liner, the device helps to contain the excess oil that normally accumulates on top of the stuffing box. Additionally, the wiper wipes off abrasive material which may stick to the wet surface of the polished rod or liner. This serves to prevent additional wear on the stuffing box packing.

10 Claims, 4 Drawing Sheets

SHOCK ABSORBER & WIPER

BACKGROUND OF THE INVENTION

1. Field of the Invention

One of the more common forms of oil recovery used is sucker rod pumping, wherein a sucker rod string is employed in a well bore and carries at the bottom end thereof a positive displacement pump. The sucker rod string and pump are reciprocated up and down inside the well tubing. The result is that the product in the well tubing is forced upwardly through the tubing to the earth's surface.

The sucker rod string is reciprocated through the use of a pumping unit located at the earth's surface. This requires the sucker rod string to be reciprocated through an opening in the well head that caps the well tubing at the earth's surface. A seal commonly referred to as "packing" is universally employed in this area to prevent well fluids and gases from escaping from around the sucker rod string and out of the well.

Typically, the sucker rod seal employs packing elements that are mechanically forced against a polished rod. The packing elements press against the polished rod and achieve a tight seal therewith to prevent, to the maximum extent possible, leakage from the interior of the well head around the polished rod and then to the exterior of the well head. The packing elements are typically forced against the polished rod in what is known as a stuffing box. Because the polished rod moves repeatedly up and down through these packing elements over a long period of time, the elements are subject to mechanical wear so that the stuffing box requires frequent monitoring to adjust or replace worn packing elements to ensure leakage prevention. To extend the life of the stuffing box seals, the packing elements must be lubricated. A difficulty that arises during start up of the well is that portions of the stuffing box may not yet be lubricated, which results in wear on the packing elements due to friction caused by the reciprocating polished rod.

It is commonly known that the service life of the polished rod is extended if a polished rod liner is employed. One hazard of the use of a polished rod liner is that in the event a polished rod breaks or slips out of the polished rod clamp, the liner will fall and the polished rod liner head will impact the top of the stuffing box resulting in possible damage to the stuffing box. When stuffing boxes are damaged or wear out they subsequently allow liquids and gases to escape. Today's stricter environmental requirements demand that steps be taken to prevent the escape of hydrocarbon gases and liquids from the well bore.

Another problem which affects the service life of packing in a stuffing box is the influx of particulate matter, such as sand or dirt into the stuffing box. On the down stroke, this abrasive material often sticks to the wet surface of the polished rod or liner and is carried into the stuffing box which hastens wear on the packing.

2. Background

There exist several patents which attempt to solve the problem of hydrocarbons escaping from around the polished rod. Patents such as U.S. Pat. No. 5,217,069 for a "Sucker Rod Wiper", and U.S. Pat. No. 4,982,787 for a "Pipe Wiper System", are all intended to be used for the purpose of wiping a sucker rod string during a well pumping operation. None of these devices are intended for mounting on top of a stuffing box. Additionally, none of the devices described in these patents are designed for shock absorption or polished rod lubricating.

Another patent that disclosed an apparatus designed to prevent hydrocarbons from escaping from around the polished rod is U.S. Pat. No. 4,345,766 entitled: "Apparatus for Sealing an Oil Well Pump Polishing Rod." This device is actually an improved stuffing box as is U.S. Pat. No. 5,170,853, for a "Pipe Wiper Assembly for a Well Drilling Unit" which is designed to replace the stuffing box on a rotary drilling rig.

U.S. Pat. No. 3,032,112 entitled "Oil Saver Shock Absorber" is a device which is placed below the stuffing box. This device is designed to prevent the impact against the bottom of the stuffing box of tools removed from the well bore. These tools are commonly raised until the upper-most portion of the tool strikes the lower extremity of the line-stripper apparatus which is attached to the casing-head. The device is not intended to protect the stuffing box from the impact of the polished rod liner head in the event that the polished rod breaks. Additionally, this device does not possess a means for lubricating the polished rod. Further, it is not designed to protect the stuffing box from foreign material or prevent product from escaping into the environment.

Finally, there exist patented devices to protect the polished rod so that it does not pick up abrasive materials which may be subsequently drawn into the stuffing box. U.S. Pat. No. 3,353,606 to Dyer teaches a polished rod protector. However, this device is not configured to provide protection from damage from the impact from the polished rod liner head in the event of polished rod breakage above the stuffing box. Furthermore, the device does not possess a means for lubricating the polished rod.

SUMMARY OF THE INVENTION

The present invention is directed to a safety shock absorber and polished rod wiper. The device generally consists of a body made of a high density elastomeric material. The design of the body is such that it is capable of absorbing the shock from the impact of a falling polished rod liner head in the event that the polished rod breaks above the stuffing box.

The body of the safety shock absorber and polished rod wiper has an interior passage to receive the polished rod. Within the interior passage are lip seals which protrude into the passage and make contact with the polished rod. The lip seals help to contain excess fluid that may leak past the stuffing box. The lip seals also serve to wipe off abrasive material which may stick to the wet surface of the polished rod or liner. This serves to prevent particulate matter from entering the stuffing box and causing excess wear of the stuffing box packing.

Formed in the body of the safety shock absorber and polished rod wiper is an interior lubricant cavity designed to receive lubricant that is particularly beneficial to lubricate the polished rod on start up. This reduces wear on the stuffing box packing that occurs during non-lubricated start up and all times during the pumping operation. Because of this constant lubrication there is a reduction of friction and corrosion which will extend the life of both the polished rod liner and the stuffing box packing.

A rigid ring is encased in the body of the shock absorber. This ring provides a strong and rigid member used to secure the shock absorber to the top of a stuffing box. A tight seal is formed between the shock absorber and the stuffing box to contain lubricant in the lubricant cavity and fluid from escaping past the stuffing box. A rubber gasket is placed between the safety shock absorber and the stuffing box to provide an improved sealing means.

It is an object of the invention to provide a shock absorber body constructed of high density elastomeric material to absorb shock in the event that the polished rod breaks or slips out of the polished rod clamp and the polished rod liner head falls to impact the stuffing box.

An additional object of the invention is to provide a shock absorber having a series of lip seals molded inside the body to wipe off the polished rod or polished rod liner on the pump's upstroke. The invention will help contain excess oil that normally accumulates on top of the stuffing box.

An additional object of the invention is to provide a lubricant cavity to lubricate the polished rod liner on pump start up to prevent the polished rod liner from running dry before well fluid is pumped up to the stuffing box and to provide constant lubrication at all times during the pumping operation. This constant lubrication can also reduce friction and corrosion during normal pumping operations which will extend the service life of both the polished rod liner and the stuffing box packing.

An additional object of the invention is to provide a shock absorber that functions as a rain and dust cap. The shock absorber keeps rain and air borne abrasive material out of the stuffing box to prolong the life of packing within the stuffing box.

An additional object of the invention is to provide an alignment indicator for use with a stuffing box. By observing the wear pattern on the shock absorber an operator can determine if the pumping unit is out of alignment.

DETAILED DESCRIPTION OF THE PREFERRED EMBODIMENTS

Figure 1:
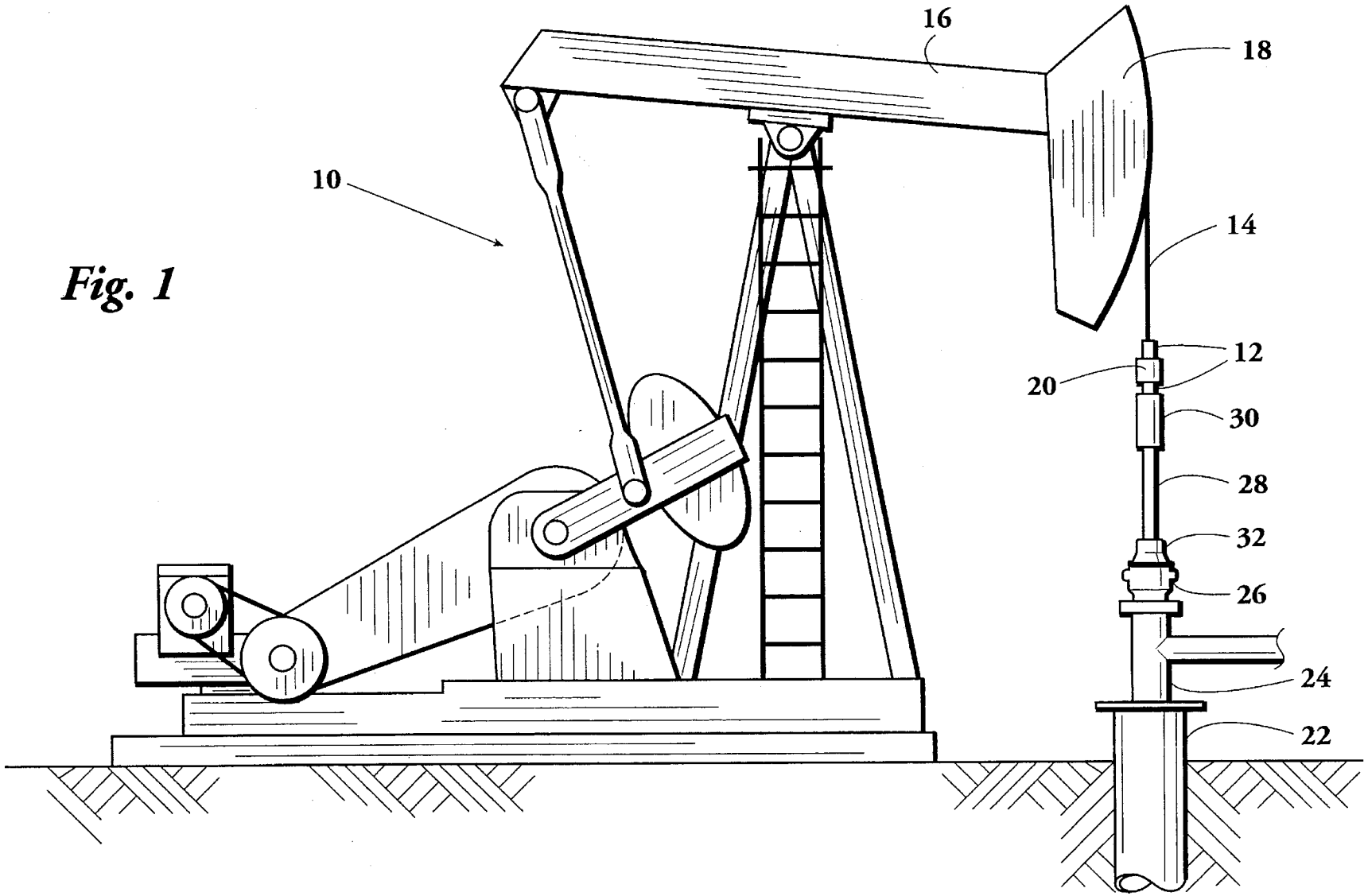
FIG. 1 is an elevational view of a typical oil well pumping system. The shock absorber is in place on top of a stuffing box. A polished rod liner, supported by a polished rod liner head extends through the shock absorber and the stuffing box.

FIG. 1 is a typical oil well pumping system designated generally 10. Oil well pumping systems such as this are used to retrieve oil from subterranean oil producing formations by reciprocating a submersible pump that is suspended downhole in the formation. The subsurface pump is attached to a string of sucker rods (not shown) which are in turn connected to a polished rod 12. The polished rod is connected to the cable 14 and is vertically reciprocated by the oscillating beam 16 and "horse head" 18 to which the cable 14 is attached. The polished rod 12 is connected to the cable 14 by means of a polished rod clamp 20. The sucker rods which extend beneath the earth's surface reciprocate inside the tubing string (not shown). The tubing string is located inside the vertical casing 22 and is attached to the bottom of the pumping tee 24. When the subsurface pump (not shown) is reciprocated up and down at the end of the sucker rods inside the tubing string, fluids are forced up the tubing string and subsequently diverted by the pumping tee 24 to a location where the fluids can be collected and stored or transported. At the top of the pumping tee 24 is positioned a stuffing box 26. The stuffing box 26 allows the polished rod to pass through it while preventing the escape of hydrocarbons from the well. The stuffing box 26 contains packing which presses firmly against the smooth polished rod 12 and allows it to reciprocate up and down while maintaining a tight seal. The tight seal results in wear on the polished rod 12. To prevent the polished rod 12 from experiencing excessive wear, a polished rod liner 28 is often employed. Polished rod liner 28 covers and protects polished rod 12 and reciprocates therewith. Polished rod liner 28 is attached to the polished rod 12 by means of a polished rod liner head 30. If the polished rod 12 slips out of the polished rod clamp 20 or if the polished rod 12 breaks above the stuffing box 26, polished rod 12 can slip out of the polished rod liner 28, fall through the stuffing box 26, and become lost underground in the drilled hole. One hazard associated with the use of a polished rod liner 28 is that if the polished rod 12 falls through the stuffing box 26 then the polished rod liner 28 can remain within the stuffing box, creating an open passageway for the escape of hydrocarbons into the environment. In order to prevent the harmful effects to the environment associated with the escape of hydrocarbons, some polished rod liner heads possess a means to capture the polished rod and prevent it from being lost down the hole. When this occurs, the full weight of the sucker rod string is supported by the polished rod liner head 30 which in turns falls and impacts the top of the stuffing box 26. The impact of the polished rod liner head on the stuffing box 26 can damage the stuffing box and result in the escape and release of hydrocarbons into the environment. To protect stuffing box 26, the safety shock absorber and wiper 32 is affixed to its upper surface to absorb the shock resulting from falling polished rod liner head 30.

Figure 2:
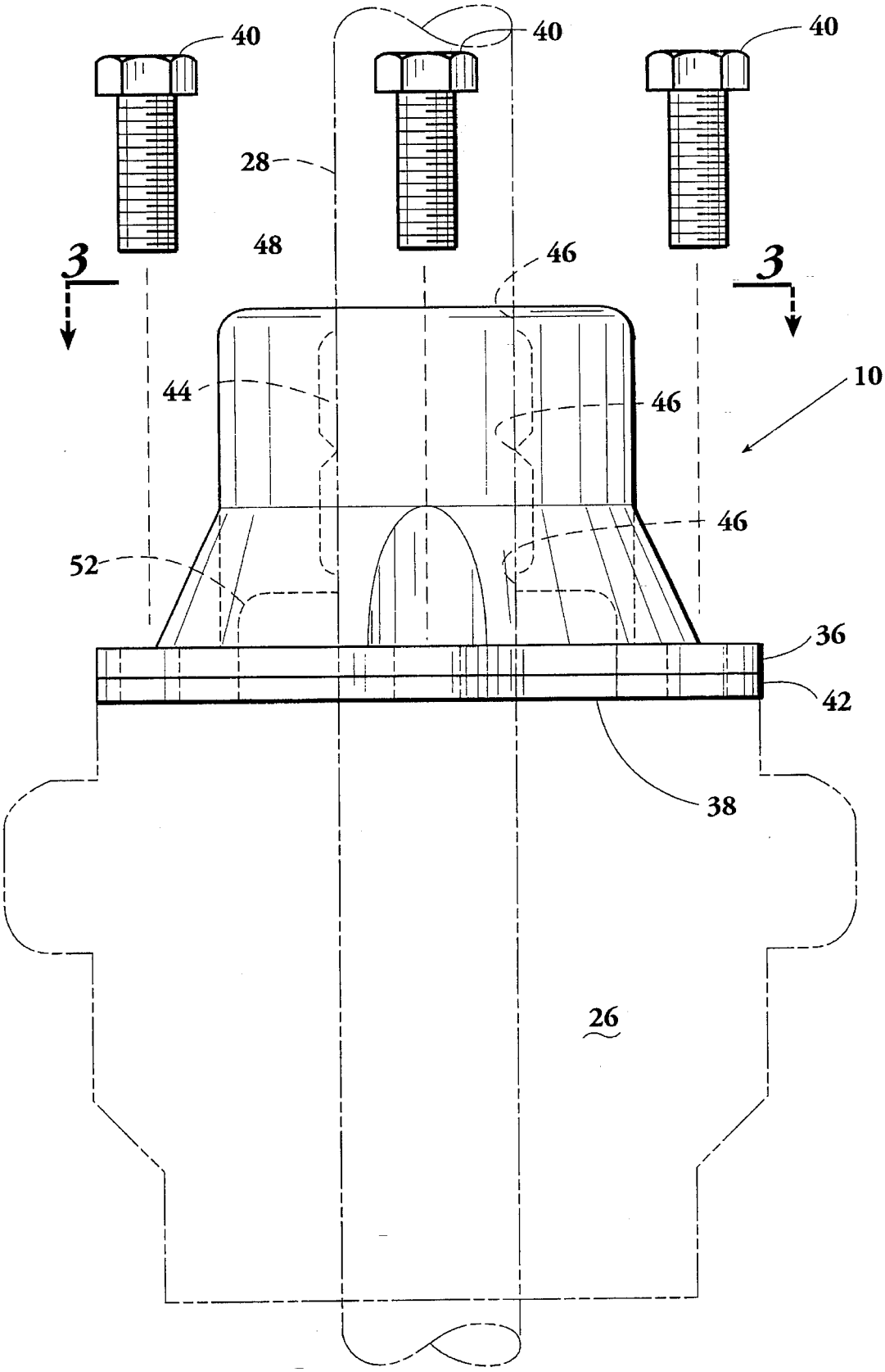
FIG. 2 is an elevational view of the shock absorber in place on top of a stuffing box.
Figure 3:
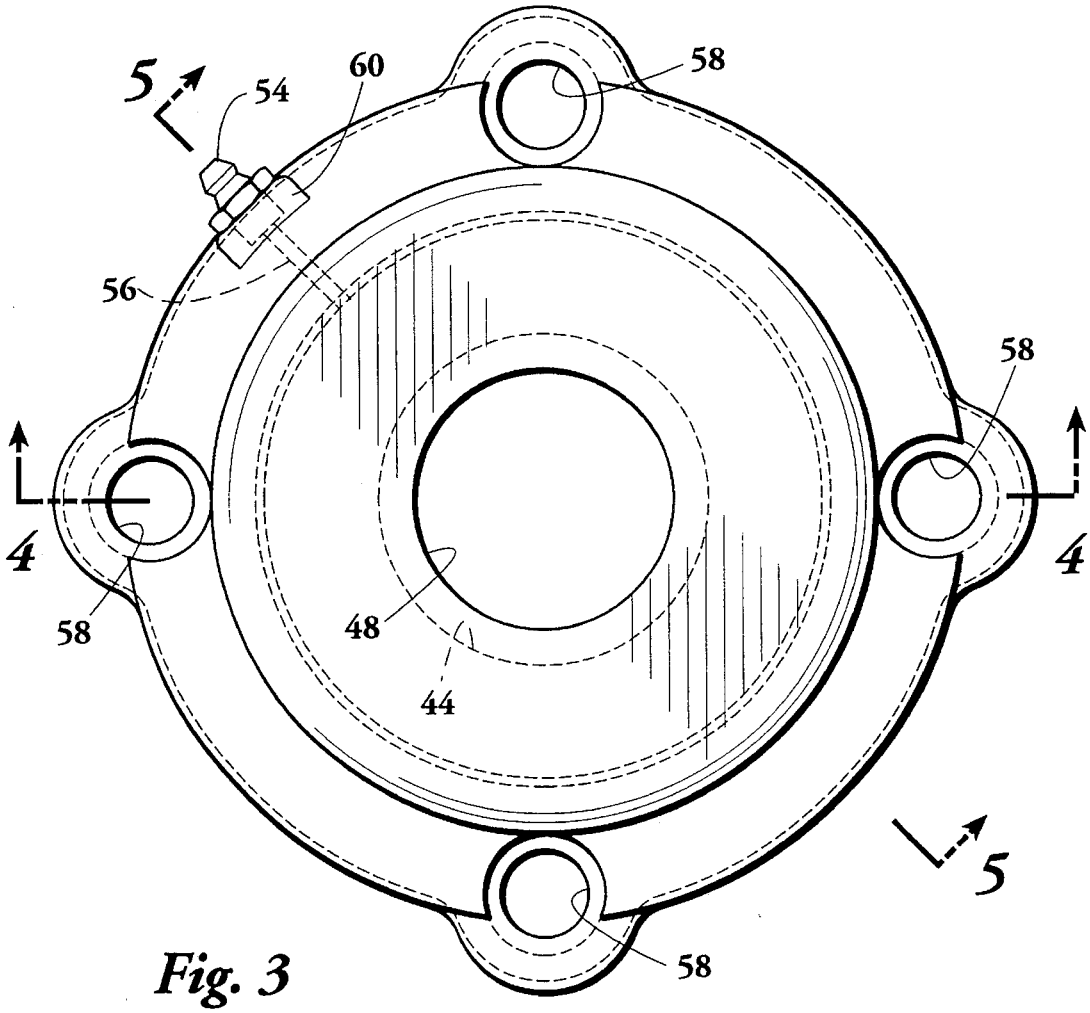
FIG. 3 is a plan view of the top of the shock absorber.
Figure 4:
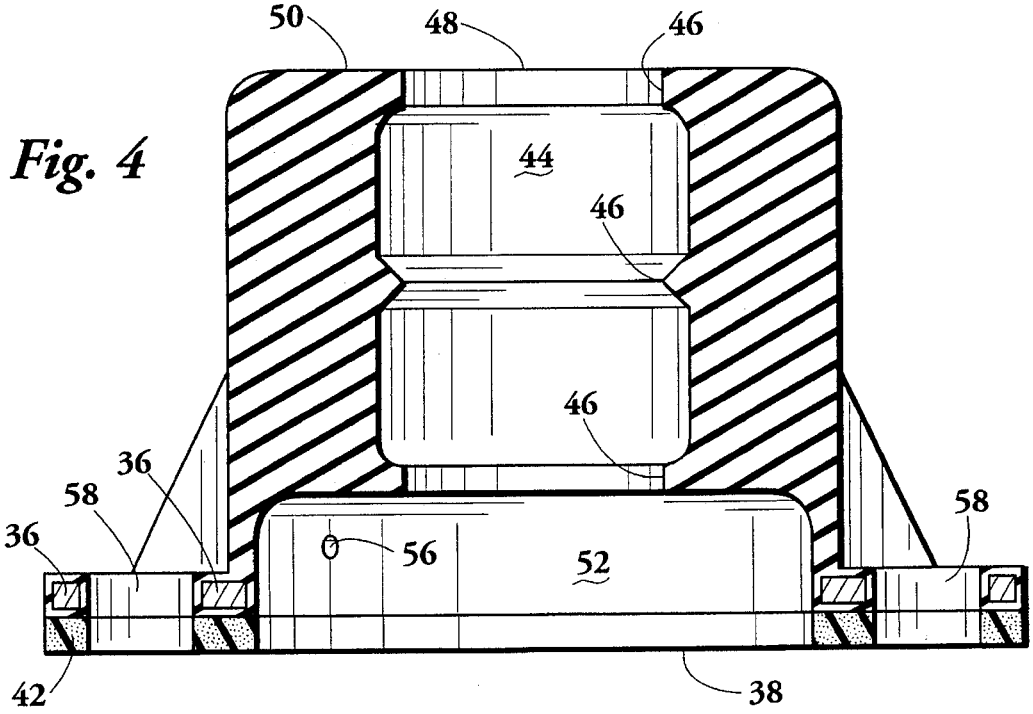
FIG. 4 is an elevational cross sectional view of the shock absorber taken along line 3—3 of FIG. 3.

Oil well pumping units 10 are often located in dry and dusty locations. Oftentimes when the oil-covered surface of polished rod 12 or polished rod liner 28 is exposed to the air on the upstroke of the pump, dirt and dust will adhere to the surface. The dust and dirt are subsequently drawn into the stuffing box on the downstroke of the pump resulting in additional wear to the internal packing of the stuffing box 26. The safety shock absorber and wiper 10 maintains close contact with the surface of the polished rod 12 or liner 28 and serves to wipe off dust and dirt and prevent its entry into the stuffing box. This serves to extend the life of the packing in the stuffing box 26 which extends the period of time before maintenance is required. FIG. 2 shows an enlarged elevation view of the safety shock absorber and wiper 10. The invention is constructed of a tough elastomeric body 34 which encases a rigid ring 36 at the body's bottom end 38. The rigid ring 36 provides a rigid surface so that the body 34 can be tightly secured to the stuffing box 26 by means of a plurality of bolts 40. A sealing means such as a rubber gasket 42 is disposed between the body 34 and the stuffing box 26 to prevent hydrocarbon leakage. An interior passage 44 is provided to receive the polished rod liner 28 and three lip seals 46 protrude from the inside of the interior passage 44 to make contact with and wipe the polished rod liner 28. The upper opening 48 located on the top surface 50 also serves as a lip seal 46 to make contact with the polished rod liner 28.

During well start-up, the packing of the stuffing box 26 is dry. The reciprocating motion of the polished rod 12 or polished rod liner 28 creates friction with the stuffing box packing that results in wear to the packing. The safety shock absorber and wiper 32 is provided with an interior lubricant cavity 52 at the bottom end 38 of the body 12. Grease is placed in the interior lubricant cavity 52 by means of a grease zert 54 which communicates with the interior lubricant cavity by channel 56 shown in FIG. 5. The grease is available to lubricate the surface of the polished rod 12 or polished rod liner 28. The grease is then drawn down into the stuffing box packing thereby eliminating unnecessary wear and friction between the stuffing box packing and the reciprocating polished rod 12 or polished rod liner 28.

Figure 6:
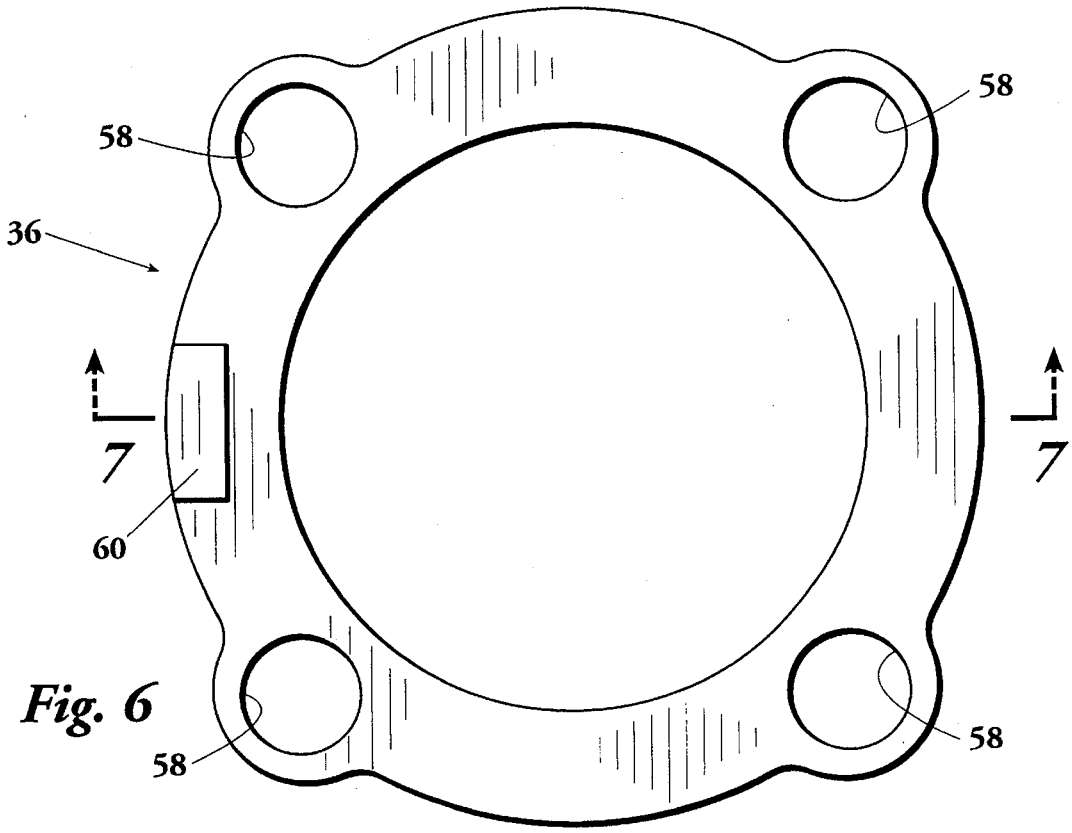
FIG. 6 is a plan view of the rigid ring that is embedded in the shock absorber.
Figure 7:
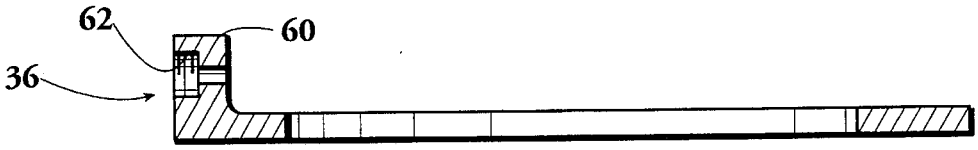
FIG. 7 is a cross-sectional view of the rigid ring taken along the line 6—6 of FIG. 6.
Figure 5:
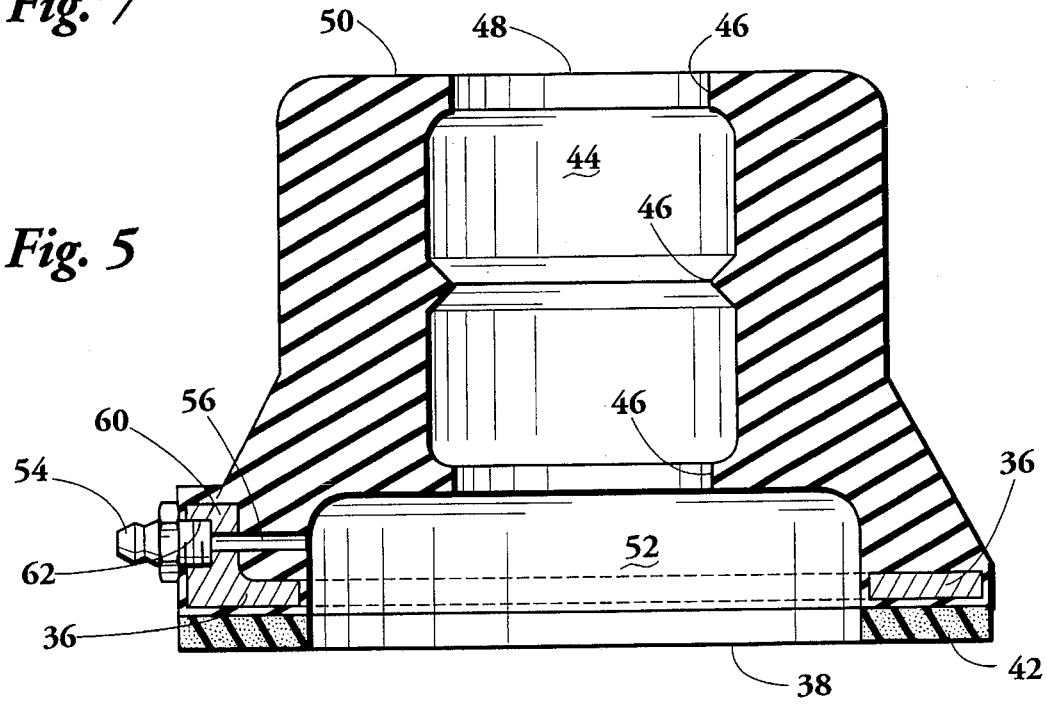
FIG. 5 is an elevational cross sectional view taken along line 4—4 of FIG. 3.

A more detailed view of the rigid ring 36 can be seen in FIGS. 5 and 6. The rigid ring 36 is provided with four bolt holes 58 to receive bolts 40 for securing the safety shock absorber and wiper 32 to the stuffing box 26. A riser 60 is provided on the rigid ring 36 to provide a rigid member for receiving the grease zert 54. A threaded grease zert receiver 62 is machined into the riser 60 for receiving the grease zert 54.

Whereas, the present invention has been described in relation to the drawings attached hereto, it should be understood that other and further modifications, apart from those shown or suggested herein, may be made within the spirit and scope of this invention.

What is claimed is:

1. A safety shock absorber and for use with a polished rod liner affixed to a polished rod by a polished rod liner head, said safety shock absorber functioning to cushion the impact of the polished rod liner head against the top of a stuffing box in the event said polished rod breaks or comes unclamped and falls, comprising:

a body having a top end and a bottom end and having an interior passage to receive said polished rod;

said body comprised of elastomeric material for protecting a stuffing box from a force typically encountered when a polished rod breaks or comes loose and the polished rod liner head drops and makes contact with said body.

2. A safety shock absorber according to claim 1 further comprising an interior lubricant cavity located at said bottom end to provide an area to receive lubricant to lubricate said polished rod liner.

3. A safety shock absorber according to claim 1 wherein said body has at least one lip seal and protruding into said interior passage to make contact with said polished rod liner.

4. A safety shock absorber according to claim 1 further comprising a sealing means to prevent leaks from said bottom end of said body during use.

5. A safety shock absorber according to claim 4 wherein said sealing means is a rubber gasket.

6. A safety shock absorber according to claim 1 further including a rigid ring encompassed within said body and located adjacent said bottom end of said body.

7. A safety shock absorber according to claim 6 wherein said rigid ring is of metal.

8. A safety shock absorber according to claim 2 further comprising a means to deliver lubricant into said lubricant cavity.

9. A safety shock absorber according to claim 8 wherein said means to deliver lubricant is a grease zert.

10. A safety shock absorber and polished rod liner for attachment on top of a stuffing box for protecting said stuffing box from the impact associated with a falling polished rod liner head, comprising:

a high density elastomeric body having a top end and a bottom end and having a cylindrical interior passage;

said body having an interior lubricant cavity located at said bottom end to lubricate said polished rod liner;

said body having at least one lip seal disposed thereon and protruding into said interior passage to make contact with said polished rod liner; and a rigid ring encompassed within said elastomeric body adjacent said bottom end of said body.

* * * * *